US010299602B2

(12) United States Patent
Wu

(10) Patent No.: US 10,299,602 B2
(45) Date of Patent: May 28, 2019

(54) CHAIR

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 59 days.

(21) Appl. No.: 15/703,673

(22) Filed: Sep. 13, 2017

(65) Prior Publication Data

US 2018/0271292 A1 Sep. 27, 2018

(30) Foreign Application Priority Data

Mar. 22, 2017 (CN) ..... 2017 2 0284167 U
Mar. 22, 2017 (CN) ..... 2017 2 0284595 U

(51) Int. Cl.

| | |
|---|---|
| ***A47C 7/40*** | (2006.01) |
| ***A47C 7/46*** | (2006.01) |
| ***A47C 3/20*** | (2006.01) |
| ***A47C 7/00*** | (2006.01) |
| ***A47C 7/38*** | (2006.01) |
| *A47C 1/032* | (2006.01) |
| *A47C 7/44* | (2006.01) |

(52) U.S. Cl.

CPC ..... *A47C 7/402* (2013.01); *A47C 3/20* (2013.01); *A47C 7/004* (2013.01); *A47C 7/38* (2013.01); *A47C 7/40* (2013.01); *A47C 1/03255* (2013.01); *A47C 1/03266* (2013.01); *A47C 7/44* (2013.01); *A47C 7/46* (2013.01)

(58) Field of Classification Search

CPC ..... A47C 7/402; A47C 7/46; A47C 7/462; A47C 7/004; A47C 7/40; A47C 7/44; A47C 7/448; A47C 3/20; A47C 1/03255; A47C 1/03266; A47C 1/032; A47C 1/03222; A47C 1/03227; A47C 1/03233; A47C 1/0325; A47C 1/03261; A47C 1/03288; A47C 1/03294; A47C 1/033; A61G 1/013

USPC ..... 297/284.1, 284.2, 284.3, 284.4, 284.5, 297/284.7, 284.8

See application file for complete search history.

(56) References Cited

U.S. PATENT DOCUMENTS

| | | | | | |
|---|---|---|---|---|---|
| 2,000,624 | A * | 5/1935 | Traver | A47C 3/021 | 248/618 |
| 3,121,592 | A * | 2/1964 | Anderson | A47C 7/46 | 297/284.1 |
| 3,565,482 | A * | 2/1971 | Blodee | A47C 7/14 | 297/284.3 |
| 3,762,769 | A * | 10/1973 | Poschl | A47C 7/462 | 297/284.4 |

(Continued)

*Primary Examiner* — Kyle J. Walraed-Sullivan
(74) *Attorney, Agent, or Firm* — Birch, Stewart, Kolasch & Birch, LLP

(57) ABSTRACT

A chair has a seat, a backrest, a lift structure, a back supporting structure, and a waist supporting structure. The backrest is deposited behind the seat. The lift structure is deposited on the backrest. The back supporting structure has a bending element and multiple supporting strips. The bending element is connected with the backrest and the lift structure, and is elastic and bendable to deform. The supporting strips are deposited on the bending element at spaced intervals from a top to a bottom of the bending element. The waist supporting structure is deposited in front of the back supporting structure. The waist supporting structure has two pivoting bases and a supporting plate. The pivoting bases are deposited on the seat. The supporting plate is pivoted between the two pivoting bases, abuts the back supporting structure, and selectively abuts the backrest.

8 Claims, 10 Drawing Sheets

(56) References Cited

U.S. PATENT DOCUMENTS 4,153,293 A * 5/1979 Sheldon ..... B60N 2/667 297/230.14
4,354,709 A * 10/1982 Schuster ..... A43D 3/1433 297/284.4
4,601,514 A * 7/1986 Meiller ..... A47C 7/462 297/284.4
4,993,164 A * 2/1991 Jacobsen ..... A47C 7/46 297/284.4
5,120,109 A * 6/1992 Rangoni ..... B60N 2/1803 297/284.3
5,197,780 A * 3/1993 Coughlin ..... A47C 7/465 192/48.91
5,217,278 A * 6/1993 Harrison ..... B60N 2/0296 192/48.91
5,320,410 A * 6/1994 Faiks ..... A47C 7/445 297/285
5,518,294 A * 5/1996 Ligon, Sr. ..... B60N 2/6673 297/284.4
D438,392 S * 3/2001 Lucci ..... A47C 7/405 D6/366
6,254,187 B1 * 7/2001 Schuster, Sr. ..... A43D 3/1433 297/284.1
6,270,158 B1 * 8/2001 Hong ..... B60N 2/667 297/284.4
6,309,018 B1 * 10/2001 Jernstrom ..... A47C 7/46 297/284.1
6,616,228 B2 * 9/2003 Heidmann ..... A47C 7/462 297/284.4
D527,557 S * 9/2006 Reimers ..... A47C 7/405 D6/716.4
7,320,503 B2 * 1/2008 Eysing ..... A47C 7/46 297/452.63
7,585,028 B2 * 9/2009 Jenkins ..... A47C 3/026 297/302.3
D684,783 S * 6/2013 Hsiao ..... D6/366
8,528,980 B1 * 9/2013 Hsiao ..... A47C 7/46 297/284.4
8,939,507 B2 * 1/2015 Thomaschewski .... B60N 2/643 297/284.1
8,991,933 B2 * 3/2015 Johansson ..... A61G 5/1062 297/284.8
9,090,189 B2 * 7/2015 Kulkarni ..... B60N 2/643
D784,748 S * 4/2017 Tsai ..... D6/716.4
D806,425 S * 1/2018 Wong ..... D6/370
2002/0130541 A1 * 9/2002 Koo ..... A47C 3/026 297/284.7
2003/0164634 A1 * 9/2003 Da Silva ..... B60N 2/66 297/284.4
2004/0124679 A1 * 7/2004 Teppo ..... A47C 7/462 297/284.4
2004/0195882 A1 * 10/2004 White ..... A47C 4/02 297/284.3
2004/0245823 A1 * 12/2004 Ligon ..... A47C 7/46 297/284.4
2005/0017555 A1 * 1/2005 Elliot ..... B60N 2/6671 297/284.4
2005/0184568 A1 * 8/2005 Schmidt ..... A47C 7/465 297/284.4
2006/0255635 A1 * 11/2006 Iijima ..... A47C 7/405 297/284.3
2008/0079298 A1 * 4/2008 Whelan ..... A47C 7/405 297/284.2
2009/0115235 A1 * 5/2009 Bock ..... A47C 7/462 297/284.7
2009/0236887 A1 * 9/2009 Lu ..... A47C 7/405 297/284.3
2010/0156158 A1 * 6/2010 LaPointe ..... A47C 7/465 297/284.7
2010/0301650 A1 * 12/2010 Hong ..... B60N 2/66 297/284.8
2011/0006570 A1 * 1/2011 Nakatsu ..... A47C 7/024 297/230.1
2011/0115268 A1 * 5/2011 Maierhofer ..... A47C 7/465 297/284.4
2012/0007399 A1 * 1/2012 Jaranson ..... B60N 2/66 297/284.4
2012/0119551 A1 * 5/2012 Brncick ..... B60N 2/643 297/284.2
2012/0174318 A1 * 7/2012 Vestergaard ..... A47C 7/40 5/613
2013/0127219 A1 * 5/2013 Gerwig ..... A47C 1/03255 297/284.3
2014/0062153 A1 * 3/2014 Grove ..... A47C 3/0252 297/284.4
2014/0077541 A1 * 3/2014 Krupiczewicz ..... A47C 31/02 297/224
2014/0077548 A1 * 3/2014 Peterson ..... A47C 1/024 297/284.4
2014/0084652 A1 * 3/2014 Norman ..... A47C 7/28 297/284.1
2014/0152064 A1 * 6/2014 Sander ..... A47C 7/28 297/285
2014/0159450 A1 * 6/2014 Guering ..... A47C 7/405 297/284.3
2014/0167464 A1 * 6/2014 Kordyl ..... A47C 7/405 297/284.3
2015/0102647 A1 * 4/2015 Grove ..... A47C 7/46 297/284.4
2015/0272333 A1 * 10/2015 Zouzal ..... B60N 2/66 297/284.7
2015/0296988 A1 * 10/2015 Machael ..... A47C 3/20 297/338
2016/0206105 A1 * 7/2016 Wagner ..... A47C 7/44
2016/0250957 A1 * 9/2016 Yoo ..... B60N 2/666 297/284.7
2017/0014680 A1 * 1/2017 Harlow ..... A47C 7/543
2017/0311725 A1 * 11/2017 Grove ..... A47C 7/467
2018/0161232 A1 * 6/2018 Grove ..... A61H 15/0078

* cited by examiner

CHAIR

This application claims the benefits of China patent applications No. 201720284167.4 and No. 201720284595.7, both filed on Mar. 22, 2017.

BACKGROUND OF THE INVENTION

1. Field of the Invention

The present invention relates to a chair, and more particularly to a chair that conforms to ergonomics and provides a supporting effect.

2. Description of Related Art

A conventional chair has a leg assembly, a seat, and a backrest. The seat is mounted on the leg assembly. The backrest is mounted behind the seat. In use, a user sits on the seat of the conventional chair, and a back of the user is supported by the backrest of the conventional chair for resting. The backrest is a plate and cannot deform to fit different body shapes of users. Therefore, a supporting effect of the backrest of the conventional chair is insufficient. The backrest may not conform to ergonomics. Thus, the user seated on the conventional chair is uncomfortable. A space is formed between the backrest and the seat of the conventional chair, making the backrest not able to fully support the rear waist of the user, and this easily causes spinal diseases.

Furthermore, the backrest of the conventional chair has a top part and a bottom part. The top part has two side edges. The bottom part is formed below the top part and has two side edges. The two side edges of the top part are respectively aligned with the two side edges of the bottom part. When the user extends the arms, the extensibility of each one of the arms is easily interfered by the top part of the backrest. The user' motion is limited by the top part of the backrest. The comfortability of the chair is decreased.

To overcome the shortcomings, the present invention tends to provide a chair to mitigate or obviate the aforementioned problems.

SUMMARY OF THE INVENTION

The main objective of the invention is to provide a chair that may well support the back and the rear waist of the user.

The chair has a seat, a backrest, a lift structure, a back supporting structure, and a waist supporting structure. The seat has a rear side. The backrest is deposited behind the rear side of the seat and has a head portion, a back portion, and a connecting rod. The head portion is deposited above the seat. The back portion is formed below the head portion of the backrest, is located behind the rear side of the seat, and has a front surface, a bottom, and a space. The space is formed through the back portion of the backrest and is located above the bottom of the back portion. The connecting rod is formed between the head portion and the back portion of the backrest, and is located above the space of the back portion. The lift structure is deposited on the bottom of the back portion of the backrest.

The back supporting structure is deposited between the backrest and the lift structure, and is located in the space of the back portion. The back supporting structure has a front surface, a bending element, and multiple supporting strips. The bending element is connected with the connecting rod of the backrest and the lift structure, and is elastic and bendable to deform. The bending element has a top end, a bottom end, a front surface, two side surfaces, a top connecting portion, and a bottom connecting portion. The top connecting portion is deposited on the top end of the bending element, and is connected to the connecting rod of the backrest. The bottom connecting portion is deposited on the bottom end of the bending element, and is connected to the lift structure. The supporting strips are deposited on the front surface of the bending element at spaced intervals from the top end of the bending element to the bottom end of the bending element. Each supporting strip has a supporting element. The supporting element is deposited on the front surface of the bending element, and has two sides and two supporting portions. The two supporting portions are respectively formed on the two sides of the supporting element, and respectively extend out of the two side surfaces of the bending element.

The waist supporting structure in front of the front surface of the back supporting structure is deposited on the seat. The waist supporting structure has two pivoting bases and a supporting plate. The pivoting bases are deposited on the seat at a spaced interval. The supporting plate is pivoted between the two pivoting bases, abuts the front surface of the back supporting structure, and selectively abuts the front surface of the back portion. The supporting plate has a body and two pivoting portions. The body is deposited between the two pivoting bases and has two sides. The pivoting portions are respectively deposited on the two sides of the body, and are respectively pivoted into the two pivoting bases.

When a user sits on the chair, the back supporting structure may support the back of the user for increasing the comfortability of the chair. The waist supporting structure is pivoted to fit and abut the rear waist of the user. The waist supporting structure may sufficiently support the rear waist of the user. Therefore, the comfortability of the chair is increased by the waist supporting structure, and the waist supporting structure may avoid causing spinal diseases of the back and the waist.

DETAILED DESCRIPTION OF PREFERRED EMBODIMENT

Figure 1:
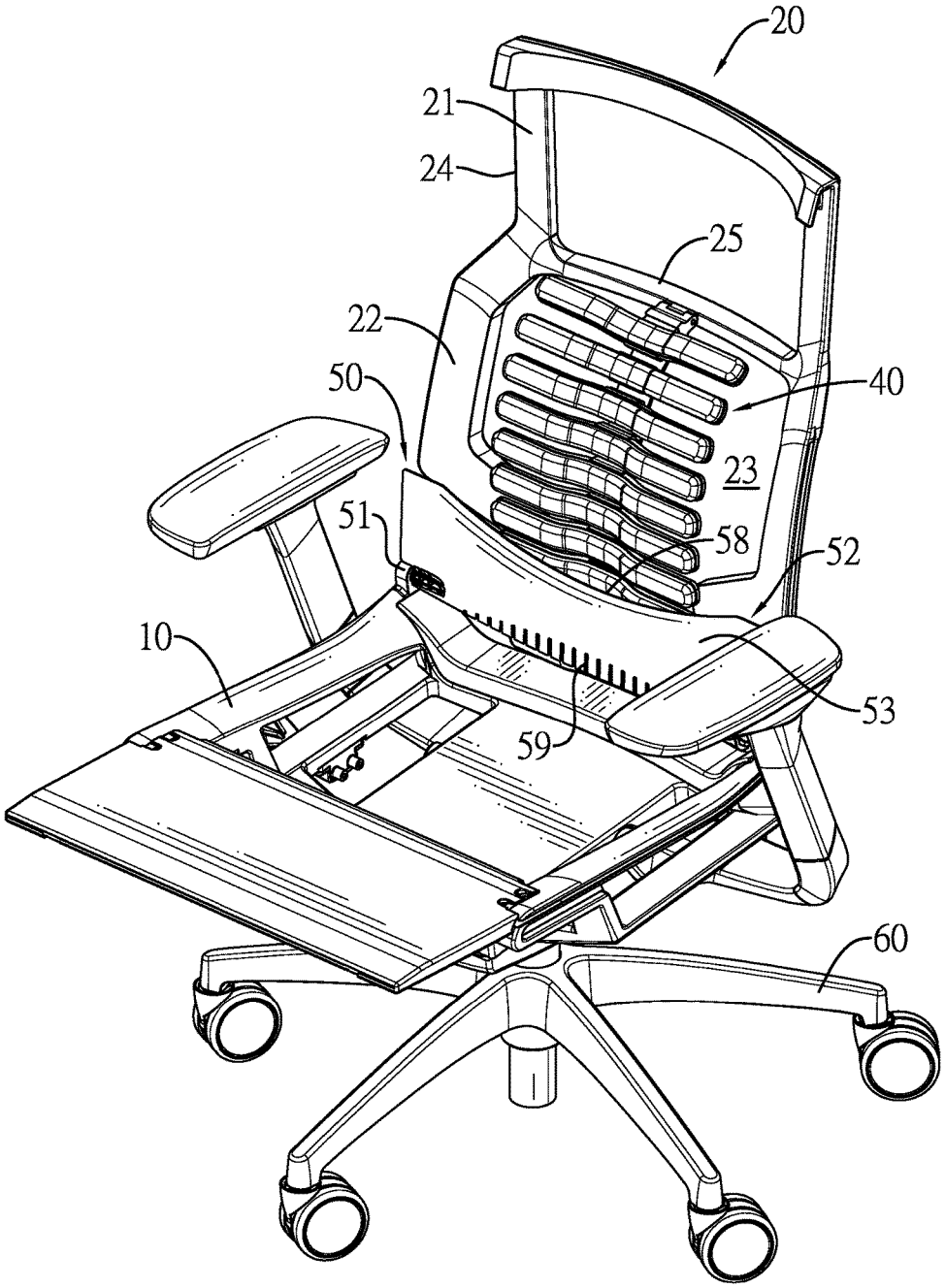
FIG. 1 is a perspective view of a chair in accordance with the present invention.
Figure 2:
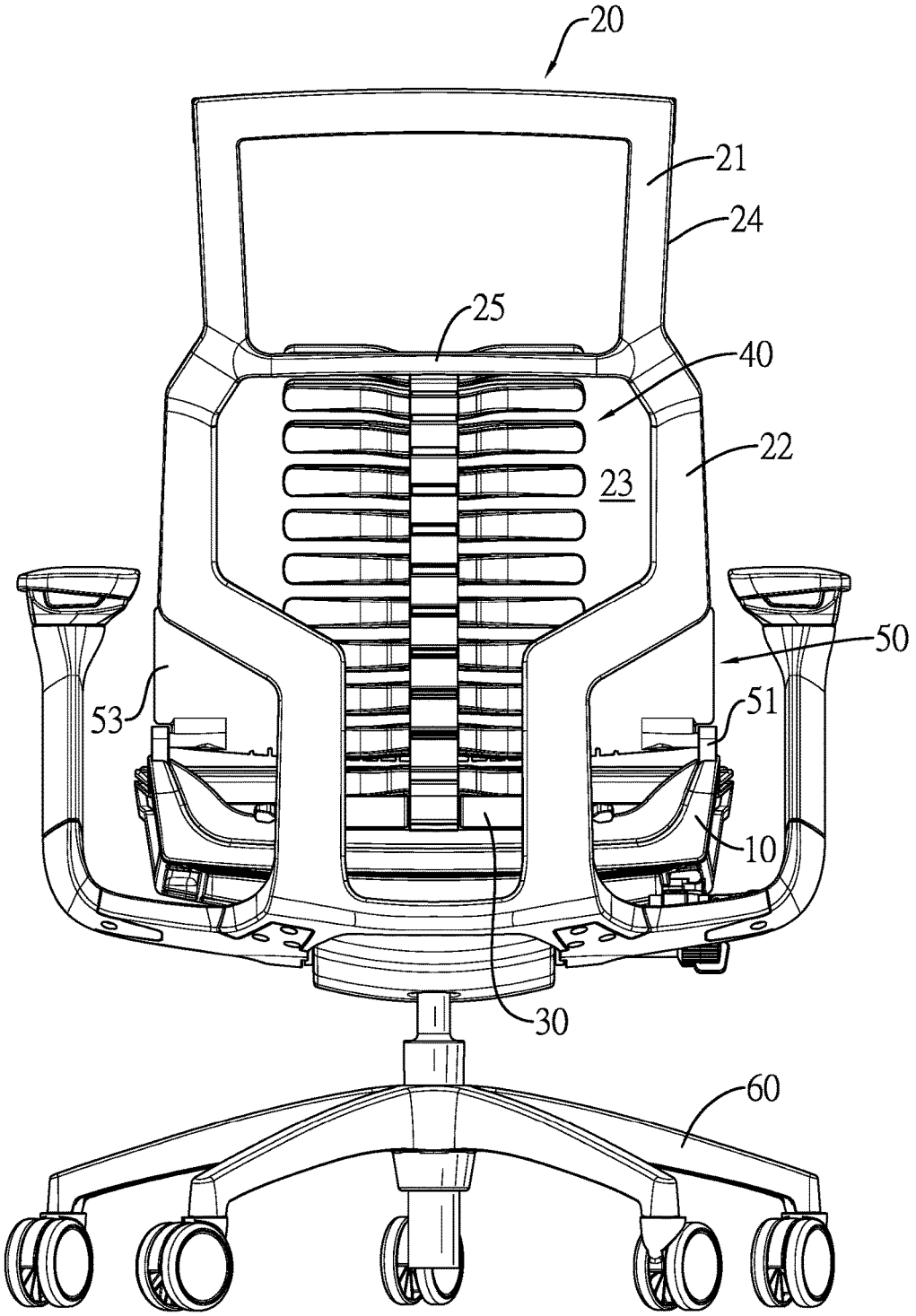
FIG. 2 is a rear side view of the chair in FIG. 1.
Figure 3:
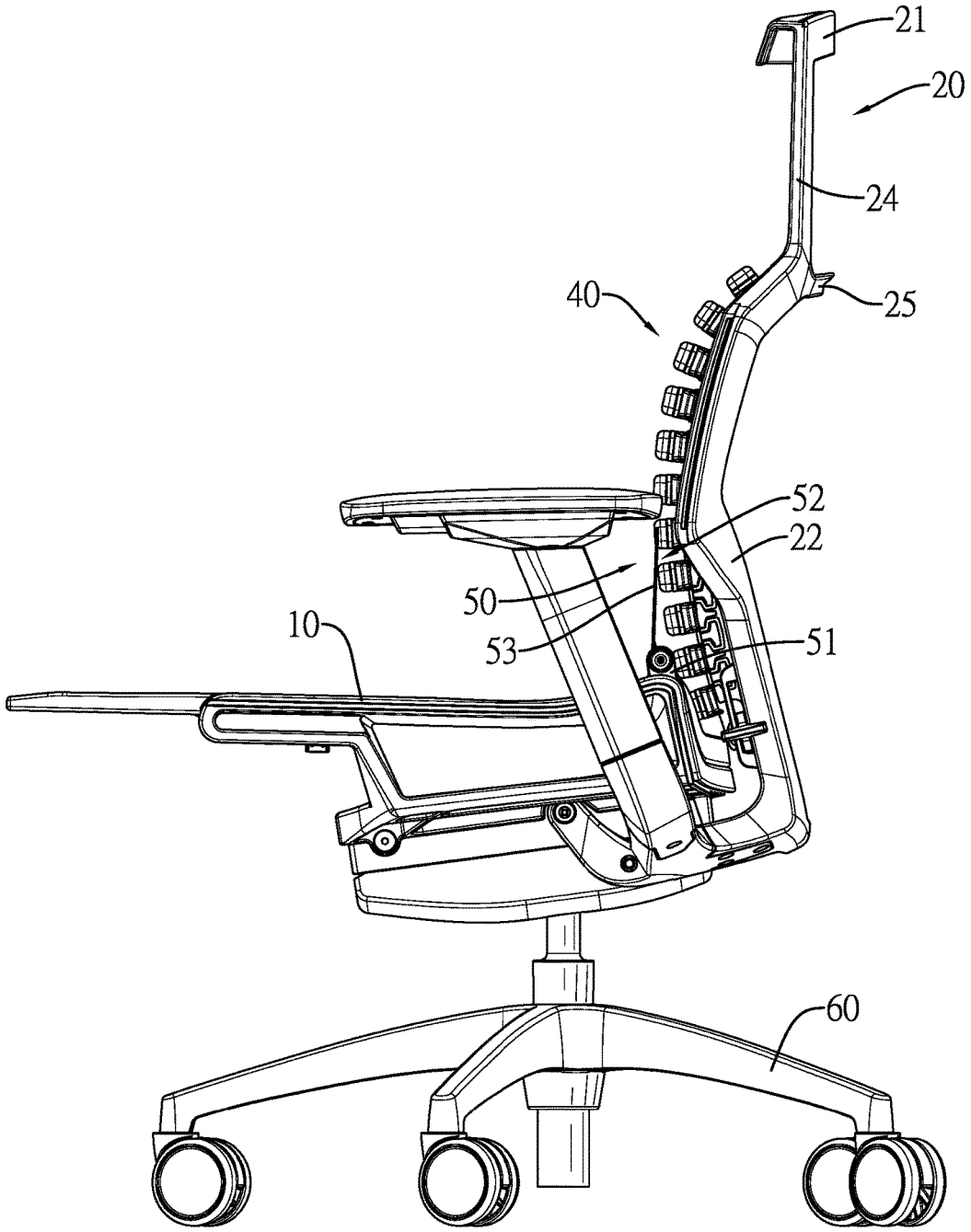
FIG. 3 is a side view of the chair in FIG. 1.

With reference to FIGS. 1 to 3, an embodiment of a chair in accordance with the present invention comprises a seat 10, a backrest 20, a lift structure 30, a back supporting structure 40, and a waist supporting structure 50. Furthermore, the chair has a leg assembly 60 deposited below the seat 10.

The backrest 20 is deposited behind a rear side of the seat 10, and has a head portion 21, a back portion 22, and a connecting rod 25. The head portion 21 is deposited above the seat 10. The back portion 22 is formed below the head portion 21 of the backrest 20, is located behind the rear side of the seat 10, and has a front surface, a bottom, and a space 23. The space 23 is formed through the back portion 22 of the backrest 20, and is located above the bottom of the back portion 22. The connecting rod 25 is formed between the head portion 21 and the back portion 22 of the backrest 20, and is located above the space 23 of the back portion 22. Furthermore, the transversal width of the head portion 21 is shorter than the transversal width of the back portion 22. The head portion 21 has two sides and two notches 24. The two notches 24 are respectively formed on the two sides of the head portion 21 and extend toward the back portion 22. In addition, the lift structure 30 is deposited on the bottom of the back portion 22 of the backrest 20.

With reference to FIGS. 1 and 4 to 7, the back supporting structure 40 is deposited between the backrest 20 and the lift structure 30, and is located in the space 23 of the back portion 20. The back supporting structure 40 has a front surface, a bending element 41, and multiple supporting strips 42.

Figure 4:
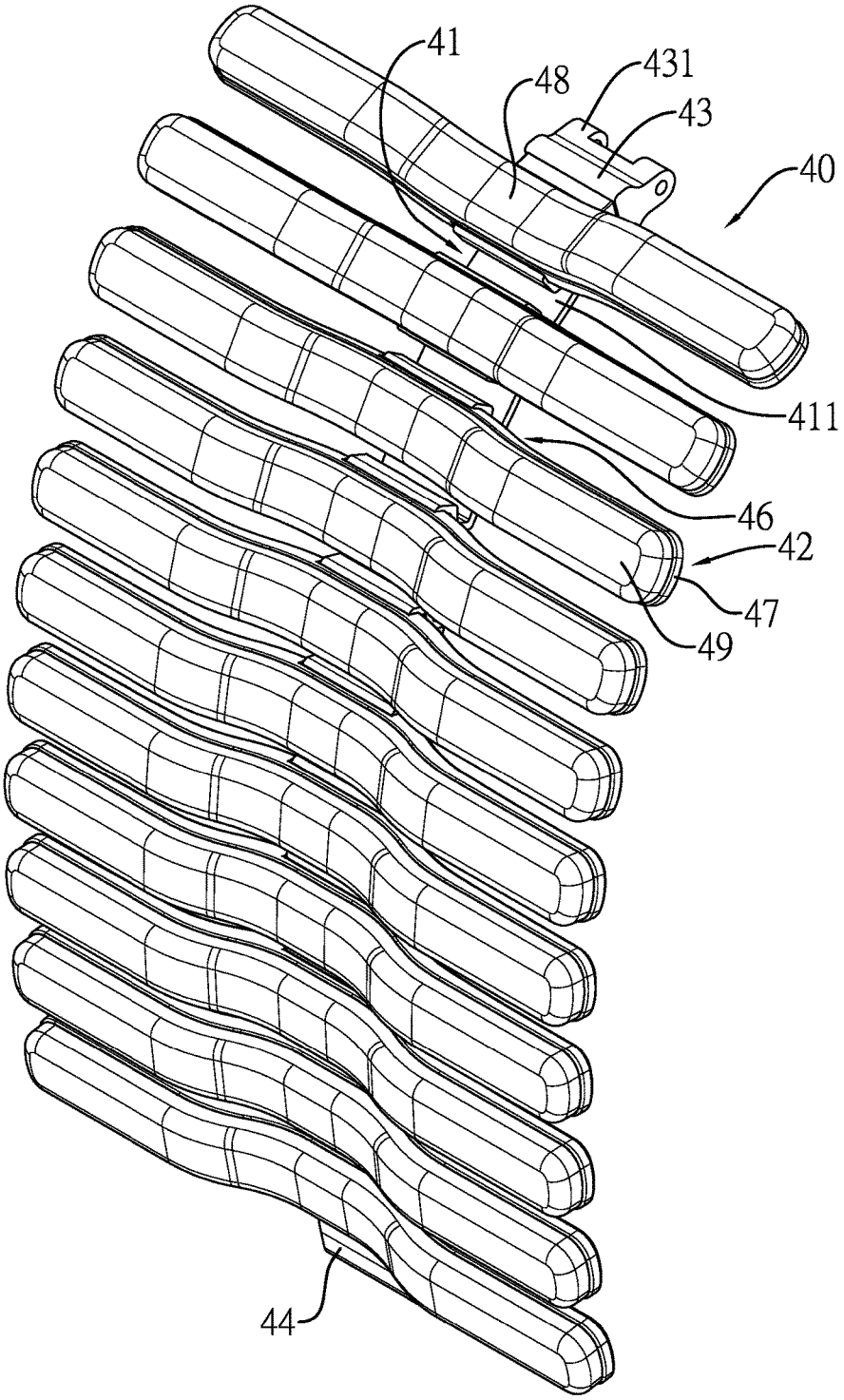
FIG. 4 is an enlarged perspective view of a back supporting structure of the chair in FIG. 1.

With reference to FIGS. 4 to 7, the bending element 41 is connected with the connecting rod 25 of the backrest 20 and the lift structure 30, and is elastic and bendable to deform. The bending element 41 has a top end, a bottom end, a front surface, two side surfaces, a top connecting portion 43, and a bottom connecting portion 44. With reference to FIGS. 1 and 4, the top connecting portion 43 is deposited on the top end of the bending element 41, and is connected to the connecting rod 25 of the backrest 20. The bottom connecting portion 44 is deposited on the bottom end of the bending element 41, and is connected to the lift structure 30. Furthermore, the bending element 41 has multiple inner recesses 411 and multiple outer recesses 412. The inner recesses 411 are formed on the front surface of the bending element 41 at spaced intervals. The outer recesses 412 are formed on a rear surface of the bending element 41 at spaced intervals. The inner recesses 411 and the outer recesses 412 are arranged in a staggered manner from the top end of the bending element 41 to the bottom end of the bending element 41. Each one of the inner recesses 411 or each one of the outer recesses 412 is selectively filled with a cushion block 45. A cross-section of each one of the inner recesses 411 and the outer recesses 412 is T-shaped, and each one of the inner recesses 411 and the outer recesses 412 is a T-shaped recess.

With reference to FIGS. 4 to 7, the supporting strips 42 are deposited on the front surface of the bending element 41 at spaced intervals from the top end of the bending element 41 to the bottom end of the bending element 41. Each supporting strip 42 has a supporting element 46. The supporting element 46 is deposited on the front surface of the bending element 41 and has two sides and two supporting portions 47. The two supporting portions 47 are respectively formed on the two sides of the supporting element 46, and respectively extend out of the two side surfaces of the bending element 41. With reference to FIG. 4, each one of the supporting elements 46 has a front surface and a concave surface 48 formed on the front surface of the supporting element 46. Each one of the supporting strips 42 has a sponge layer 49 deposited on the front surface of a corresponding one of the supporting elements 46.

With reference to FIGS. 1 to 3, the waist supporting structure 50 in front of the front surface of the back supporting structure 40 is deposited on the seat 10. The waist supporting structure 50 has two pivoting bases 51 and a supporting plate 52. The pivoting bases 51 are deposited on the seat 10 at a spaced interval. The supporting plate 52 is pivoted between the two pivoting bases 51, abuts the front surface of the back supporting structure 40, and selectively abuts the front surface of the back portion 22 of the backrest 20. The supporting plate 52 has a body 53 and two pivoting portions 54. The body 53 is deposited between the two pivoting bases 51 and has two sides. The pivoting portions 54 are respectively deposited on the two sides of the body 53, and are respectively pivoted into the two pivoting bases 51, and this enables the supporting plate 52 to pivot relative to the two pivoting bases 51.

Figure 8:
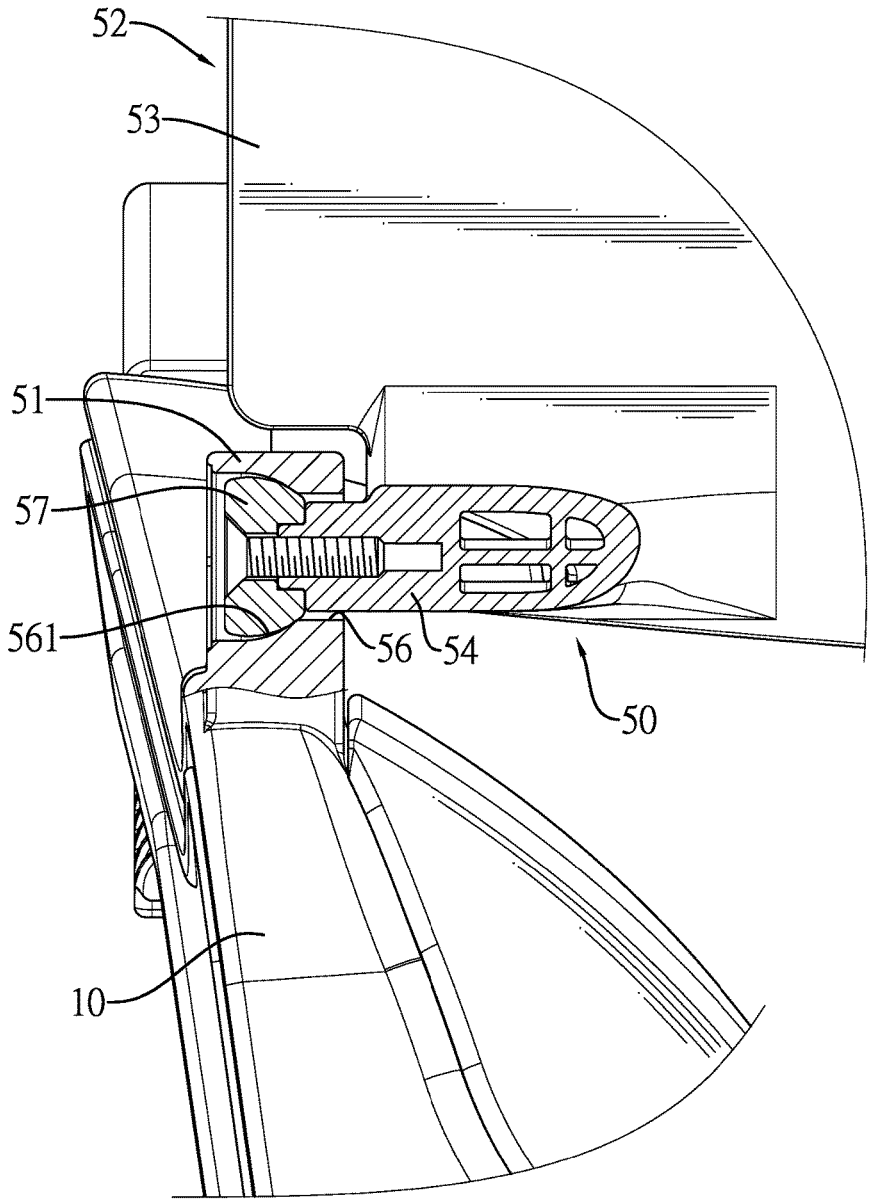
FIG. 8 is an enlarged front side view in partial section of a waist supporting structure of the chair in FIG. 1.

With reference to FIGS. 2, 3, and 8, each one of the two pivoting bases 51 has an inner side, an outer side, a pivoting hole 56, and a hemispheric recess 561. The two inner sides of the two pivoting bases 51 face each other. The outer sides of the two pivoting bases 51 are respectively opposite to the two inner sides of the two pivoting bases 51. The two pivoting holes 56 are respectively formed on the two inner sides of the two pivoting bases 51. The two hemispheric recesses 561 are respectively formed on the two outer sides of the two pivoting bases 51, and are respectively in communication with the two pivoting holes 56. The two pivoting portions 54 are respectively inserted into the two pivoting holes 56 of the two pivoting bases 51. The supporting plate 52 has two locating blocks 57. The two locating blocks 57 are hemispheric, are respectively deposited on the two pivoting portions 54, and are respectively inserted into the two hemispheric recesses 561.

Figure 9:
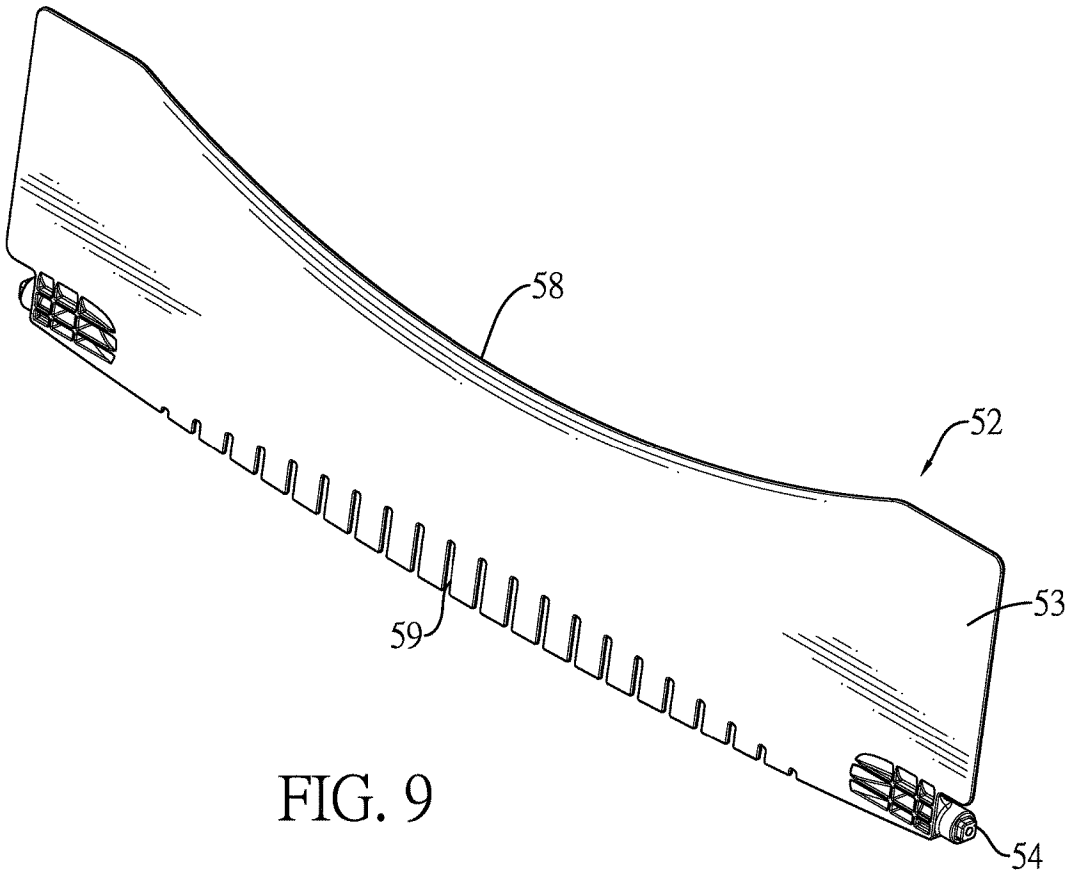
FIG. 9 is an enlarged perspective view of the waist supporting structure of the chair in FIG. 1.
Figure 10:
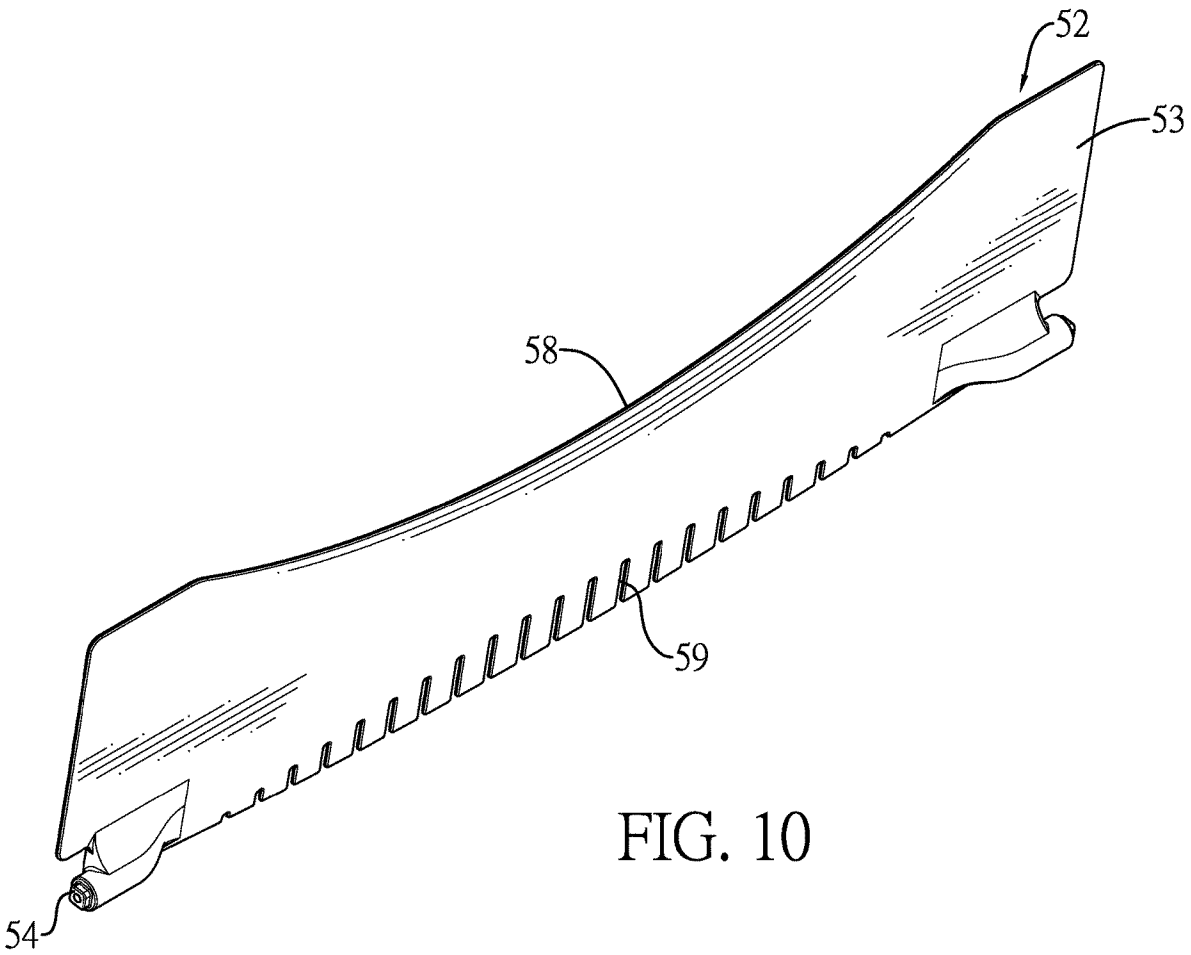
FIG. 10 is another enlarged perspective view of the waist supporting structure of the chair in FIG. 1.

With reference to FIGS. 9 and 10, the body 53 of the supporting plate 52 has a top edge and a concave portion 58. The concave portion 58 is formed on the top edge of the body 53 and extends downwardly. The body 53 of the supporting plate 52 has a bottom edge and multiple gaps 59. The gaps 59 are formed through the bottom edge of the body 53 at spaced intervals and extend upwardly. The body 53 has a center. The lengths of the gaps 59 are gradually decreased from the center of the body 53 to the two sides of the body 53. This means the length of the gap 59 that is deposited at the center of the body 53 is longer than the lengths of the gaps 59 that are deposited at the two sides of the body 53. The body 53 of the supporting plate 52 has a front surface, and the front surface of the body 53 is curved to form a bow shape in a top view.

With reference to FIGS. 1 to 3, when a user sits on the chair, the back supporting structure 40 may support the back and the waist of the user. The waist supporting structure 50 may support the rear waist of the user. The back and the waist of the user abut the back supporting structure 40, and the rear waist of the user abuts the waist supporting structure 50. The bending element 41 and the supporting strips 42 of the back supporting structure 40 are pressed by the user simultaneously. The bending element 41 of the back supporting structure 40 may generate an elastic bending deformation for fitting a curve of the back of the user. The supporting portions 47 of the supporting strips 42 may extend for supporting the back and the waist of the user. The supporting plate 52 of the waist supporting structure 50 is pivoted to fit and abut the rear waist of the user. The waist supporting structure 50 may support the rear waist of the user for increasing the comfortability of the chair.

Figure 5:
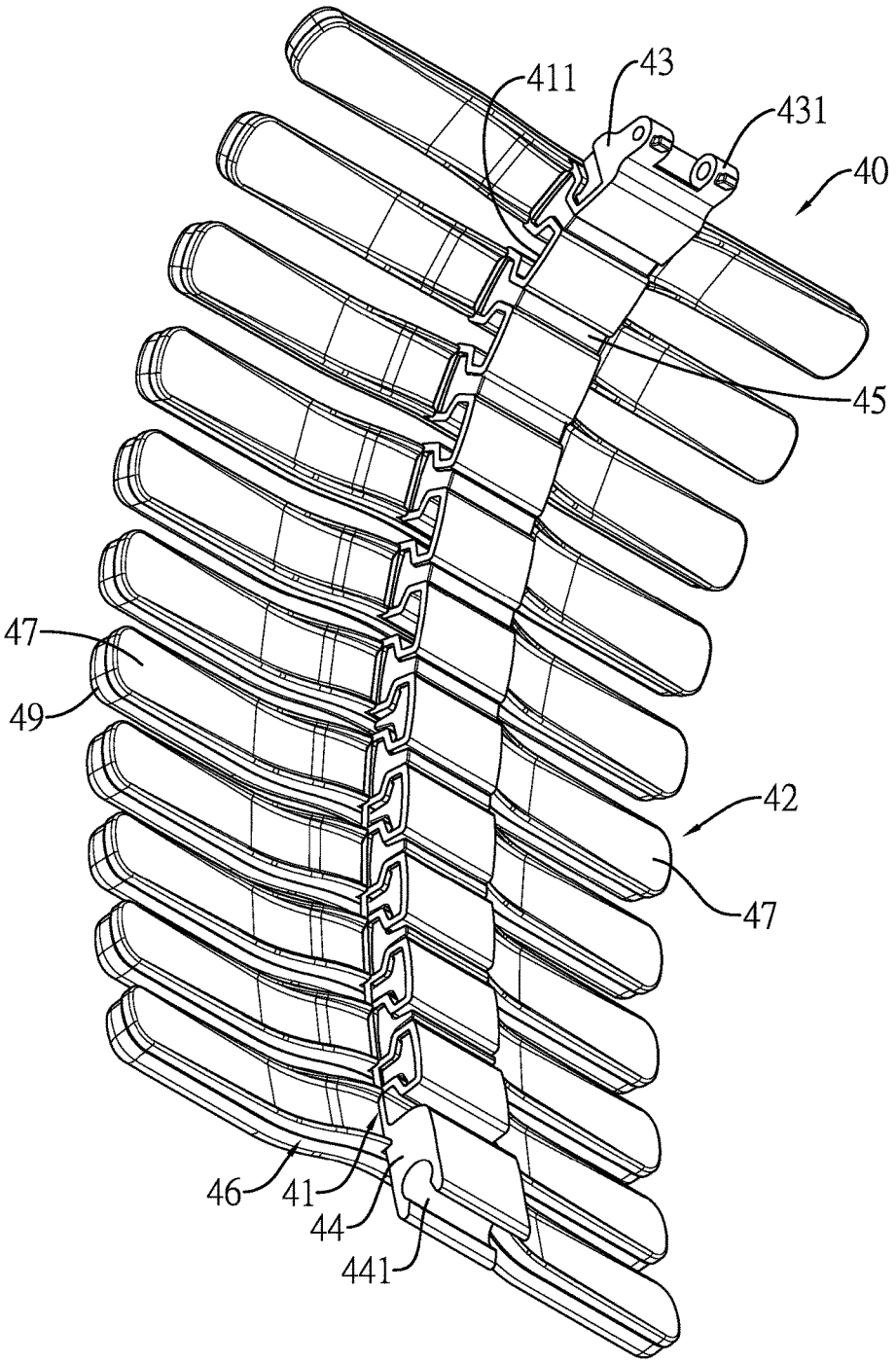
FIG. 5 is another enlarged perspective view of the back supporting structure of the chair in FIG. 1.
Figure 6:
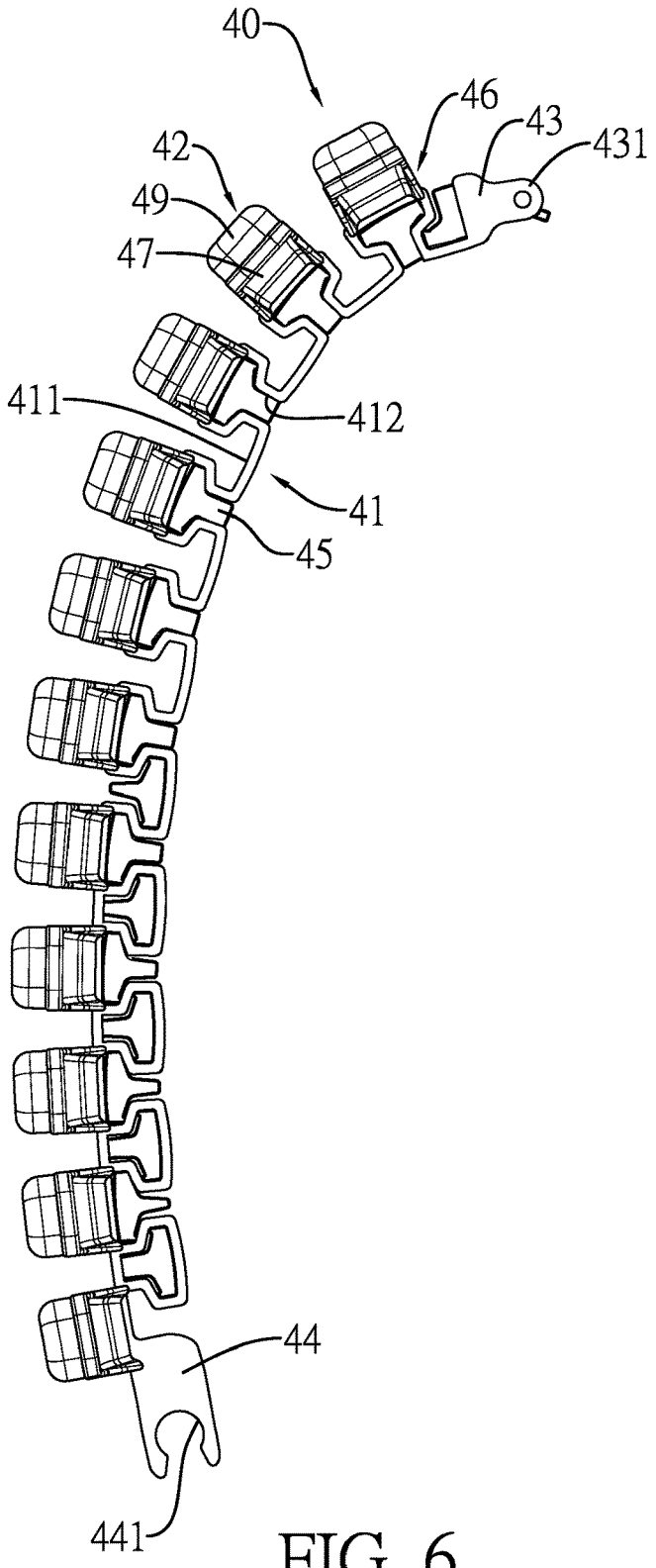
FIG. 6 is an enlarged side view of the back supporting structure of the chair in FIG. 1.

With reference to FIGS. 4 to 6, the bending element 41 of the back supporting structure 40 may generate different elastic bending deformations for fitting the different curves of the backs of the users. The bending element 41 and the supporting portions 47 of the supporting strips 42 may support the back and the waist of the user sitting on the chair. When the user leans the back on the back supporting structure 40, the supporting strips 42 may abut the back of the user to increase the contact area between the supporting strips 42 and the back of the user. The back supporting structure 40 conforms to ergonomics and has a good adaptability, a good supporting effect, and a good sitting comfortability.

With reference to FIG. 6, the inner recesses 411 and the outer recesses 412 are formed on the bending element 41 and arranged in a staggered manner for increasing the degree of freedom of the elastic deformation of the bending element 41. When the user leans the back on the back supporting structure 40, the bending element 41 may well fit and abut the curve of the back of the user. The strength of the bending element 41 in bending can be increased by the cushion blocks 45 in the inner recesses 411 and the outer recesses 412 to prevent the elastic deformation of the bending element 41 transferring to the plastic deformation of the bending element 41. Then, the life time of the bending element 41 is increased. When the back and the waist of the user leave the back supporting structure 40, the bending element 41 can restore quickly by the cushion blocks 45.

Figure 7:
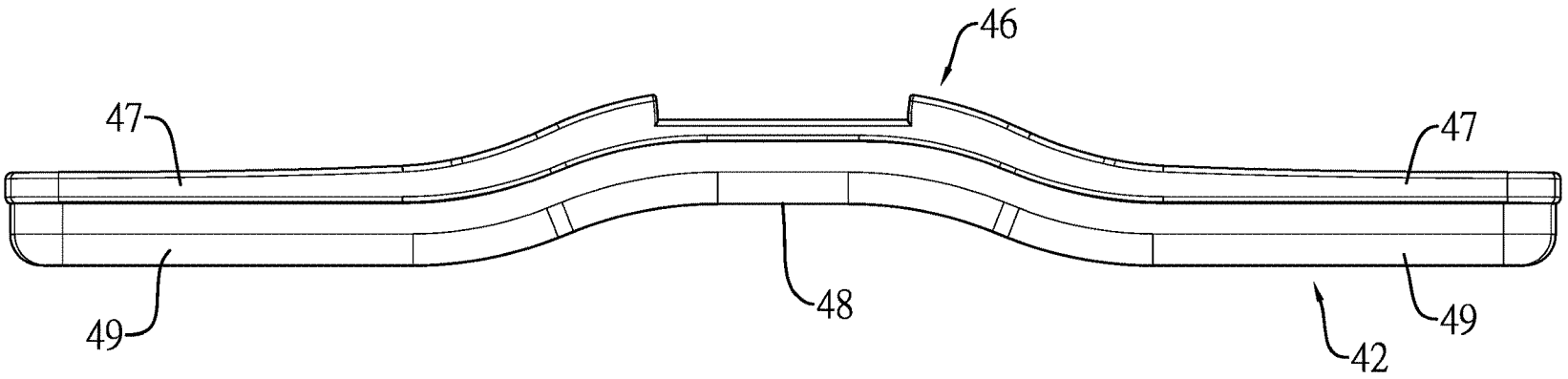
FIG. 7 is an enlarged top view of the back supporting structure of the chair in FIG. 1.

With reference to FIG. 7, the user leans the back on the concave surfaces 48 of the supporting elements 46. The two supporting portions 47 of each one of the supporting elements 46 are expanded for increasing the connecting areas of the supporting strips 42 in contact with the back of the user. The supporting strips 42 can expand and shrink slightly by the action of the user for fitting and massaging the back of the user. The comfortability of the back supporting structure 40 is increased. The sponge layers 49 are respectively deposited on the front surfaces of the supporting elements 46 for providing a soft touch to prevent the supporting elements 46 from directly pressing the back of the user.

With reference to FIGS. 1 and 9, when the user leans the back on the backrest of the chair, the concave portion 58 of the body 53 may support and fit the lower back and the waist of the user. The lower back and the waist of the user are not pressed by the body 53, thereby increasing the comfortability of the chair.

With reference to FIGS. 1, 9, and 10, when the users lean on the supporting plate 52, the body 53 may deform to fit the different curves of the users. The gaps 59 can provide the adequate deformation spaces to the body 53. In the deformation of the body 53, the body 53 keeps fitting with the lower back and the waist of the user. The lower back and the waist of the user are not pressed by the body 53. The gaps 59 may prevent the body 53 from deforming too much, so as to avoid damage. The lengths of the gaps 59 are gradually decreased from the center of the body 53 to the two sides of the body 53. The bottom edge of the body 53 fits well with the rear back and the waist of the user. The supporting effect of the supporting plate 52 is good.

With reference to FIG. 4, the supporting plate 52 generates different deformations to fit with different users. The two pivoting portions 54 and the two locating blocks 57 may rotate in the corresponding pivoting holes 56 of the two pivoting bases 51. The stability of the supporting plate 52 pivoted across the two pivoting bases 51 is increased for preventing the supporting plate 52 from deforming too much, so as to avoid damage. Breaking of the pivoting portions 54 and the pivoting bases 51 is prevented, too.

Furthermore, the front surface of the body 53 is curved to form a bow shape in a top view. When the user leans on the supporting plate 52, the front surface of the body 53 may fit with the lower back and the waist of the user for increasing the supporting effect and the sitting comfortability.

With reference to FIGS. 4 to 6, two lugs 431 are deposited on the top connecting portion 43. An engaging groove 441 is formed on a bottom of the bottom connecting portion 44. A pivoting rod is inserted through the lugs 431 and the connecting rod 25 for pivoting the back supporting structure 40 on the backrest 20. The lift structure 30 may be inserted into the engaging groove 441. The back supporting structure 40 is easily deposited between the backrest 20 and the lift structure 30 by the lugs 431 and the engaging groove 441.

With reference to FIGS. 2 and 3, the user sits on the chair and operates the lift structure 30 to adjust a height of the bottom end of the bending element 41. When the height of the bottom end of the bending element 41 is changed, the curvature of the bending element 41 and the internal stress of the bending element 41 are changed. Thus, the supporting force of the back supporting structure 40 is affected. Therefore, the height of the bottom end of the bending element 41 may be adjusted to satisfy different users with the adjustable supporting forces of the back supporting structure 40.

With reference to FIGS. 1 and 2, the two notches 24 are respectively formed on the two sides of the head portion 21. The arms of the user can swing freely and are not interfered by the backrest 20 for increasing the sitting comfortability of the chair.

Accordingly, the bending element 41 may be bent and deformed. The supporting strips 42 provide the supporting effect. The back supporting structure 40 can fit with users of different sizes and provides the good sitting comfortability. Furthermore, the supporting plate 52 of the waist supporting structure 50 may be pivoted to fit and support the lower back and the rear waist of the user. Therefore, the comfortability of the chair is increased by the waist supporting structure 50. The waist supporting structure 50 may prevent spinal diseases of the back and the waist.

What is claimed is:

1. A chair comprising:

a seat having a rear side;

a backrest disposed behind the rear side of the seat and having a head portion disposed above the seat;

a back portion formed below the head portion of the backrest, located behind the rear side of the seat, and having a front surface;

a bottom; and a space formed through the back portion of the backrest and located above the bottom of the back portion; and a connecting rod formed between the head portion and the back portion of the backrest, and located above the space of the back portion;

a lift structure disposed on the bottom of the back portion of the backrest;

a back supporting structure disposed between the backrest and the lift structure, located in the space of the back portion, and having a front surface;

a bending element connected with the connecting rod of the backrest and the lift structure, being elastic and bendable to deform, and having a top end;

a bottom end;

a front surface;

two side surfaces;

a top connecting portion disposed on the top end of the bending element and connected to the connecting rod of the backrest; and a bottom connecting portion disposed on the bottom end of the bending element and connected to the lift structure; and multiple supporting strips disposed on the front surface of the bending element at spaced intervals from the top end of the bending element to the bottom end of the bending element, and each supporting strip having a supporting element disposed on the front surface of the bending element, and having two sides; and two supporting portions respectively formed on the two sides of the supporting element and respectively extending out of the two side surfaces of the bending element; and a waist supporting structure in front of the front surface of the back supporting structure disposed on the seat, and having two pivoting bases disposed on the seat at a spaced interval; and a supporting plate pivoted between the two pivoting bases, abutting the front surface of the back supporting structure, selectively abutting the front surface of the back portion, and having a body disposed between the two pivoting bases and having two sides; and two pivoting portions respectively disposed on the two sides of the body and respectively pivoted into the two pivoting bases, wherein the bending element has a rear surface;

multiple inner recesses formed on the front surface of the bending element at spaced intervals; and multiple outer recesses formed on the rear surface of the bending element at spaced intervals, wherein the inner recesses and the outer recesses are arranged in a staggered manner from the top end of the bending element to the bottom end of the bending element, wherein each one of the inner recesses and the outer recesses is selectively filled with a cushion block, and wherein a cross-section of each one of the inner recesses and the outer recesses is T-shaped, and each one of the inner recesses and the outer recesses is a T-shaped recess.

2. The chair as claimed in the claim 1, wherein each one of the supporting elements has a front surface and a concave surface formed on the front surface of the support element.

3. The chair as claimed in claim 2, wherein each one of the supporting strips has a sponge layer, and the sponge layer is disposed on the front surface of a corresponding one of the supporting elements.

4. The chair as claimed in claim 1, wherein the body of the supporting plate has a top edge and a concave portion, and the concave portion is formed on the top edge of the body and extends downwardly.

5. The chair as claimed in claim 4, wherein the body of the supporting plate has a bottom edge and multiple gaps, and the multiple gaps are formed through the bottom edge of the body at spaced intervals and extend upwardly.

6. The chair as claimed in claim 5, wherein the body has a center, and lengths of the multiple gaps are gradually decreased from the center of the body to the two sides of the body.

7. The chair as claimed in claim 1, wherein the body of the supporting plate has a front surface, and the front surface of the body is curved to form a bow shape in a top view.

8. A chair comprising:

a seat having a rear side;

a backrest disposed behind the rear side of the seat and having a head portion disposed above the seat;

a back portion formed below the head portion of the backrest, located behind the rear side of the seat, and having a front surface;

a bottom; and a space formed through the back portion of the backrest and located above the bottom of the back portion; and a connecting rod formed between the head portion and the back portion of the backrest, and located above the space of the back portion;

a lift structure disposed on the bottom of the back portion of the backrest;

a back supporting structure disposed between the backrest and the lift structure, located in the space of the back portion, and having a front surface;

a bending element connected with the connecting rod of the backrest and the lift structure, being elastic and bendable to deform, and having a top end;

a bottom end;

a front surface;

two side surfaces;

a top connecting portion disposed on the top end of the bending element and connected to the connecting rod of the backrest; and a bottom connecting portion disposed on the bottom end of the bending element and connected to the lift structure; and multiple supporting strips disposed on the front surface of the bending element at spaced intervals from the top end of the bending element to the bottom end of the bending element, and each supporting strip having a supporting element disposed on the front surface of the bending element, and having two sides; and two supporting portions respectively formed on the two sides of the supporting element and respectively extending out of the two side surfaces of the bending element; and a waist supporting structure in front of the front surface of the back supporting structure disposed on the seat, and having two pivoting bases disposed on the seat at a spaced interval; and a supporting plate pivoted between the two pivoting bases, abutting the front surface of the back supporting structure, selectively abutting the front surface of the back portion, and having a body disposed between the two pivoting bases and having two sides; and two pivoting portions respectively disposed on the two sides of the body and respectively pivoted into the two pivoting bases, wherein the two pivoting bases have two inner sides of the two pivoting bases facing each other;

two outer sides;

two pivoting holes respectively formed on the two inner sides of the two pivoting bases; and two hemispheric recesses respectively formed on the two outer sides of the two pivoting bases and respectively extending to the two pivoting holes;

the two pivoting portions are respectively inserted into the two pivoting holes of the two pivoting bases; and the supporting plate has two locating blocks being hemispheric, respectively disposed on the two pivoting portions, and respectively inserted into the two hemispheric recesses.

* * * * *